US006625916B1

(12) United States Patent
Dionne

(10) Patent No.: US 6,625,916 B1
(45) Date of Patent: Sep. 30, 2003

(54) CONVERSION OF FIREARMS TO FIRE REDUCED-ENERGY AMMUNITION

(75) Inventor: Sylvain Dionne, Quebec (CA)

(73) Assignee: SNC Technologies Inc., Le Gardeur (CA)

( * ) Notice: Subject to any disclaimer, the term of this patent is extended or adjusted under 35 U.S.C. 154(b) by 0 days.

(21) Appl. No.: 09/434,151

(22) Filed: Nov. 4, 1999

(51) Int. Cl.[7] ..... F41C 27/00; F42B 8/02

(52) U.S. Cl. ..... 42/16; 42/25; 102/444; 102/469

(58) Field of Search ..... 42/16, 25; 102/444, 102/469, 470

(56) References Cited

U.S. PATENT DOCUMENTS

| | | | | | |
|---|---|---|---|---|---|
| 2,021,498 | A | * | 11/1935 | Campbell | 102/470 |
| 2,573,451 | A | * | 10/1951 | Keller et al. | 102/469 |
| 2,970,543 | A | * | 2/1961 | Duffield | 102/470 |
| 3,237,335 | A | * | 3/1966 | Kerr | 42/8 |
| 3,292,538 | A | * | 12/1966 | Umbach et al. | 102/444 |
| 3,771,415 | A | * | 11/1973 | Into et al. | 42/25 |
| 3,776,095 | A | * | 12/1973 | Atchisson | 42/16 |
| 4,098,016 | A | * | 7/1978 | Foote | 42/16 |
| 4,142,314 | A | * | 3/1979 | Foote | 42/16 |
| 4,169,329 | A | * | 10/1979 | Atchisson | 42/16 |
| 4,231,177 | A | * | 11/1980 | Foote | 42/16 |
| 4,362,107 | A | * | 12/1982 | Romer et al. | 102/444 |
| 4,515,064 | A | * | 5/1985 | Hohrein | 42/49.02 |
| 4,719,859 | A | * | 1/1988 | Ballreich et al. | 102/444 |
| 5,016,536 | A | * | 5/1991 | Brighton | 102/444 |
| 5,086,703 | A | * | 2/1992 | Klein | 102/444 |
| 5,351,598 | A | * | 10/1994 | Schuetz | 42/25 |
| 5,359,937 | A | * | 11/1994 | Dittrich | 102/430 |
| 5,448,940 | A | * | 9/1995 | Schuetz et al. | 89/185 |
| 5,492,063 | A | * | 2/1996 | Dittrich | 102/430 |
| 5,499,569 | A | * | 3/1996 | Schuetz | 42/25 |
| 5,520,019 | A | * | 5/1996 | Schuetz | 42/49.02 |
| 5,740,626 | A | * | 4/1998 | Schuetz et al. | 42/106 |
| 6,095,051 | A | * | 8/2000 | Saxby | 102/444 |
| 6,253,682 | B1 | * | 7/2001 | Saxby | 102/444 |
| 6,415,718 | B1 | * | 7/2002 | Saxby | 102/444 |
| 6,427,600 | B2 | * | 8/2002 | Saxby | 102/444 |
| 6,439,123 | B1 | * | 8/2002 | Dionne et al. | 102/444 |

FOREIGN PATENT DOCUMENTS

| | | | |
|---|---|---|---|
| CH | 66750 | * | 10/1913 |
| CH | 67197 | * | 1/1914 |
| DE | 143926 | * | 11/1902 |
| DE | 1578213 | * | 10/1971 |

OTHER PUBLICATIONS

Lyman Gun Sight Products, Lyman Reloading Handbook for Rifle, Pistol and Muzzle Loading, 1970, 45th Edition, pp. 78, 79, 226, and 227.*

* cited by examiner

*Primary Examiner*—Darren W. Ark
(74) *Attorney, Agent, or Firm*—David J. French

(57) ABSTRACT

A training kit is designed for use with a firearm normally having a standard bolt that is provided at the forward end with a bolt recess for receiving and embracing the head end of a standard cartridge. The training kit is provided with a training bolt having a circular recess of a diameter that will not receive and embrace the head end of the standard cartridge thereby limiting placement of a standard cartridge beyond the reach of the firing pin. Rounds of reduced-energy training ammunition are provided with a head end of complementary dimensions that permits the head end to be seated within the recess of a conversion bolt, and therefore fired.

12 Claims, 7 Drawing Sheets

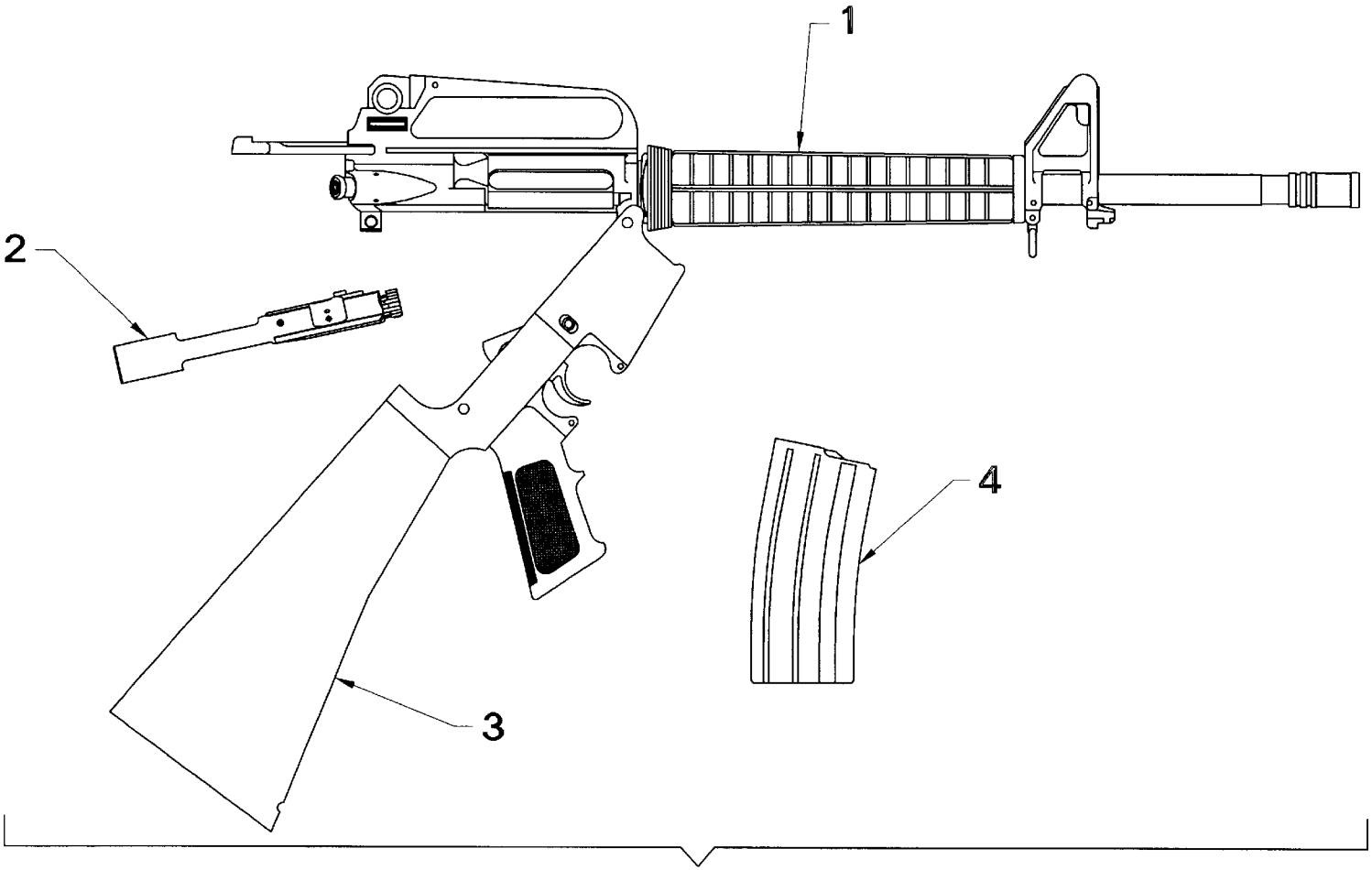
FIGURE 1 - PRIOR ART

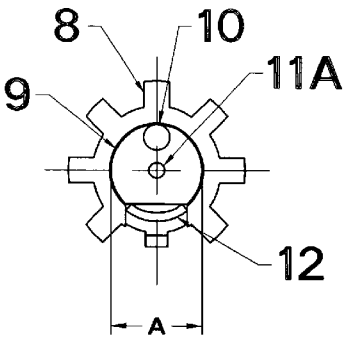
FIGURE 2B - PRIOR ART
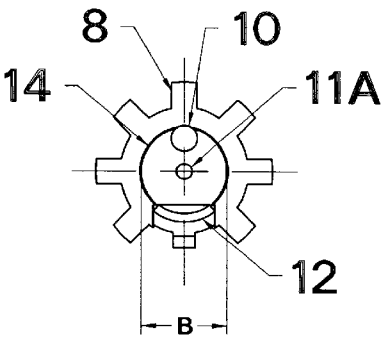
FIGURE 3B
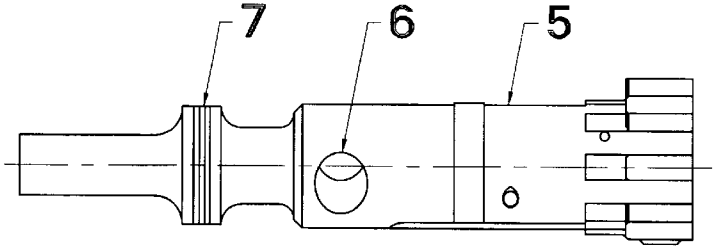
FIGURE 2A - PRIOR ART
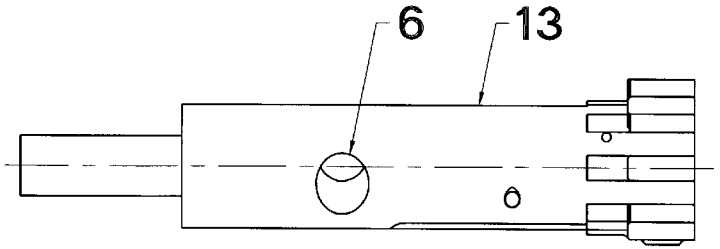
FIGURE 3A

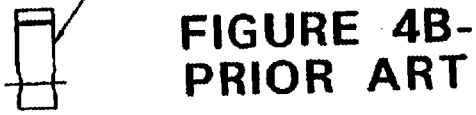
FIGURE 4B-
PRIOR ART
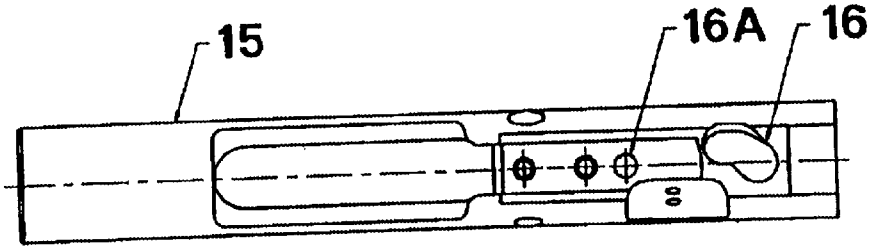
FIGURE 4A - PRIOR ART
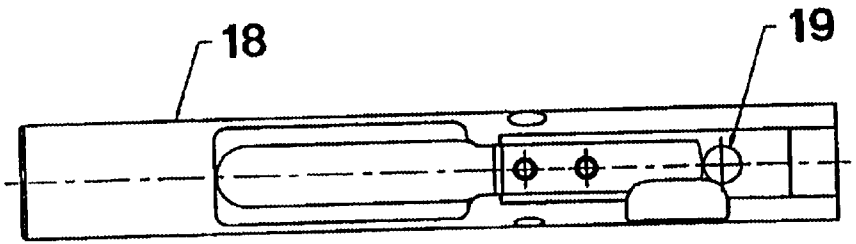
FIGURE 5

SECTION Y-Y

SECTION X-X

CONVERSION OF FIREARMS TO FIRE REDUCED-ENERGY AMMUNITION

FIELD OF THE INVENTION

This invention relates to the fields of firearms and ammunition and provisions for modifying automatic firearms for training purposes. In particular, it relates to automatic gas-operated weapons adapted to fire reduced-energy training ammunition in a blow-back mode and to said training ammunition.

BACKGROUND TO THE INVENTION

In military and police firearms applications almost all of the ammunition consumed is used in training. For some training purposes, however, normal ammunition is not adequate. An alternative type of known training ammunition, represented by U.S. Pat. No. 5,359,937 (adopted herein by reference), fires a low-mass projectile relying on a special, reduced-energy cartridge designed to provide cycling of suitably-modified, recoil-operated or gas-operated automatic and semi-automatic weapons.

An advantage of the low-energy training ammunition is that it has a shorter range and lower penetration capacity than standard ammunition. This permits use of smaller, less-secure firing ranges as training facilities. If standard ammunition were accidentally employed in these facilities, unexpected dangers would arise from the increased striking power and range of standard ammunition.

Said training ammunition, in combination with certain modifications to the weapon, allows normal recoil and cartridge case ejection through a pure blow-back action. Such a system, when firing appropriate marking cartridges, makes for effective close-range, force-on-force training. This system enhances the realism and training value of interactive scenario tactical training because it allows trainees to use their service weapons in a representative manner in exercises simulating, for example, counter-terrorism, close quarters combat, trench clearing, fighting in wooded areas, urban fighting, and protection of dignitaries.

Modifications required to permit cycling of 9 mm automatic or semi-automatic weapons while firing low-energy ammunition, for example, generally include replacing or modifying the barrel and sometimes replacing or adding one or two other components, depending on the weapon involved. These modifications also serve to increase safety because the caliber of the substitute training barrel may be smaller than the diameter of the projectiles in standard 9 mm ammunition. If an attempt is made to chamber a standard cartridge in such a training-adapted or converted firearm, the barrel will not normally admit entry of the standard projectile. This ensures that such converted weapons cannot fire standard, live ammunition.

Firearms of other calibers, such as caliber .45 for pistols and 5.56 mm for automatic rifles, may also be converted to fire the same reduced-energy training ammunition using similar training barrels as described above for converted 9 mm pistols.

When firing standard ammunition, with its abundant associated energy, it is necessary in many weapons to lock the barrel to the slide (for pistols) or to the bolt carrier assembly (for gas-operated rifles) during the beginning of their rearward motion for a period long enough for the projectile to exit the barrel muzzle while the breech is still closed. This allows the chamber pressure to drop before the breech opens to extract and eject the spent cartridge case. A locking mechanism couples the barrel to the slide or bolt carrier assembly for the first portion of the recoil, and then releases said slide or bolt carrier assembly, usually with the aid of a cam. Upon unlocking, the slide or bolt carrier assembly continues its rearward travel until, after the spent cartridge case has been ejected, it returns under the influence of the recoil spring to receive and chamber the next round from the magazine en route to its in-battery position.

In a training system it is necessary to omit this barrel locking mechanism and, by so doing, the recoil action becomes pure blow-back of the slide or bolt carrier assembly only. This must be done because there is not enough energy in low-energy training cartridges to precipitate sufficient recoil to unlock the barrel from the slide or bolt carrier assembly in their standard configurations.

As implied above, 5.56 mm automatic weapons, as typified by the family of gas-operated M16A2 rifles and carbines made by the 1991 Colt's Manufacturing Company Inc., can be modified to fire 9 mm reduced-energy training ammunition as represented by U.S. Pat. No. 5,359,937. This may be done by changing the barrel fitted to the upper receiver assembly as well as altering the bolt in the bolt carrier assembly to remove the locking mechanism. While such a design ensures the exclusion of live service ammunition from being fired from a converted weapon, it is costly to implement and awkward for the user due to the excessive number of weapon components involved.

An alternative approach is to modify only the bolt carrier assembly, leaving untouched the barrel, upper receiver assembly and the lower receiver buttstock assembly. In this way, the weapon can be rapidly converted to fire said reduced-energy training ammunition, by simply exchanging the service bolt carrier assembly for a training bolt carrier assembly. It is, therefore, an objective of this invention to provide a quick and easy conversion of this class of weapons from its service operating configuration to a training operating configuration without modification to the barrel, the upper receiver assembly or said lower receiver buttstock assembly.

This means, however, that live service ammunition would not be excluded from chambering in the standard 5.56 mm barrel, which is connected to the upper receiver assembly. Thus, for this approach to be acceptable from a safety point of view, it is essential that a mechanism be included in the design of the training bolt carrier assembly, in combination with the said reduced-energy cartridge, that will positively prevent the firing of live service ammunition from a 5.56 mm weapon converted to fire said training cartridges.

It is, therefore, another objective of this invention to provide a conversion system for the class of gas-operated weapons typified by the family of M16A2 rifles and carbines that will permit the safe firing of training ammunition while positively excluding the firing of a live round of service ammunition should one be inadvertently chambered during training exercises or practice scenarios.

The invention in its general form will first be described, and then its implementation in terms of specific embodiments will be detailed with reference to the drawings following hereafter. These embodiments are intended to demonstrate the principal of the invention and the manner of its implementation. The invention in its broadest and more specific forms will be further described, and defined, in each of the individual claims which conclude this specification.

SUMMARY OF THE INVENTION

This invention is preferably directed to gas-operated automatic weapons, as typified by the Colt M16A2 family of rifles and carbines, converted to fire reduced-energy training ammunition as represented by U.S. Pat. No. 5,359,937. The invention is also applicable to all cases where a training bolt carrier assembly having a recessed end on the bolt is substituted in place of a standard service bolt carrier assembly without further modification to the weapon.

According to one aspect of the invention a training bolt is provided for a converted firearm wherein the training bolt has a recess through which the firing pin advances. The recess is dimensioned to exclude the head end of a standard cartridge, locating the head end beyond reach of the firing pin. The recess is, however, dimensioned to receive the head end of training ammunition that will fit into the recess, locating the primer of the training round within reach of the firing pin.

The selective shaping of the recess and training round may be effected by reducing the diameter of the recess to exclude entry by the head end of a standard round while receiving the head end of a training round which is of reduced diameter. Alternately, the recess may have a protrusion in its bottom, seating end that excludes entry of the head end of a standard cartridge; while training cartridges may have a complementary recess formed within the head end that will interfit with the protrusion. Thus, the training round can be seated for firing, but a standard round will be excluded. Similarly, the rim of the training cartridge and the matching front end recess of the training bolt could be dimensioned to be of some shape other than circular.

In the conversion of an M-16 type firearm the standard pin, extractor and ejection pin may be retained. The new training bolt carrier assembly may omit the barrel locking feature present in the standard weapons by: (1) replacing the cam groove in the bolt carrier by a simple cylindrical hole through which a standard cam pin rigidly attaches the training bolt to the training bolt carrier; and (2) eliminating the gas port. Since the bolt locking lugs are, therefore, unable to rotate and engage the barrel extension in the in-battery or closed position, the converted weapon operates in a pure blow-back mode when firing said reduced-energy training ammunition. Further, because there is no locking action, retention of the bolt locking lugs is optional.

The round-engaging end of the bolt of an M-16 type firearm has a recess. Normally, the rim at the head end of a standard round of service ammunition fits snugly into this recess and is gripped there by the extractor, which fits over the rim and settles into the extraction groove. In this position, the primer face at the head end of the cartridge is flush against the flat bottom of the bolt recess, adjacent the tip of the retracted firing pin located therein. When the trigger is pulled, the firing pin thrusts forward into the recess region and strikes the primer, thereby firing the weapon.

With a training round having a reduced head-end rim diameter, however, the recess in the front end of the training bolt is not large enough to accept a standard round of 5.56 mm service ammunition. Therefore, since the depth of the recess is considerably greater than the stroke of the firing pin, there is no contact between the tip of the firing pin and the primer after the firing pin has been activated and thrust into the recess. As a result, the round does not fire and the modified weapon will not expose users to the risk that a standard round may be inadvertently discharged.

According to a further aspect of the invention, the training bolt carrier assembly is free to recoil as part of a blow-back cycling operation for reloading the weapon. Blow-back operation may be achieved by employing a telescopically lengthening cartridge case as described in U.S. Pat. Nos. 5,359,937 and 5,492,063. The external form of the reduced-energy training ammunition as represented by U.S. Pat. No. 5,359,937, may be produced in a form that is identical to that of the standard 5.56 mm cartridge case except for the diameter of the rim at the head of the case. This diameter may, however, be reduced so that it will fit snugly into the reduced diameter of the training bolt. Thus, such training ammunition will seat properly within the recess formed in the training bolt, with its head end flush against he bottom of the recess, adjacent and in the path of the retracted tip of the firing pin. In this configuration, the firing pin will strike the primer and fire the weapon in the normal way when said firing pin is activated. The telescopic lengthening of the cartridge will effect the blow-back cycling of the weapon.

The foregoing summarizes the principal features of the invention and some of its optional aspects. The invention may be further understood by the description of the preferred embodiments, in conjunction with the drawings, which now follow.

BRIEF DESCRIPTION OF THE DRAWINGS

FIG. 1 shows the major components of a typical prior art rifle in the class of M16A2 gas operated rifles and carbines.

FIGS. 2A and 2B are respectively side and end views of a prior art bolt from the bolt carrier assembly of FIG. 1.

FIGS. 3A and 3B are the same views as in FIGS. 2A and 2B of a training bolt according to the invention.

FIG. 4A is a top view of a prior art bolt carrier from the bolt carrier assembly of FIG. 1.

FIG. 4B is a side view of a prior art cam pin from the bolt carrier assembly of FIG. 1.

FIG. 5 is the same view as in FIG. 4A of a training bolt carrier according to the invention.

DESCRIPTION OF THE PREFERRED EMBODIMENT

Figure 6:
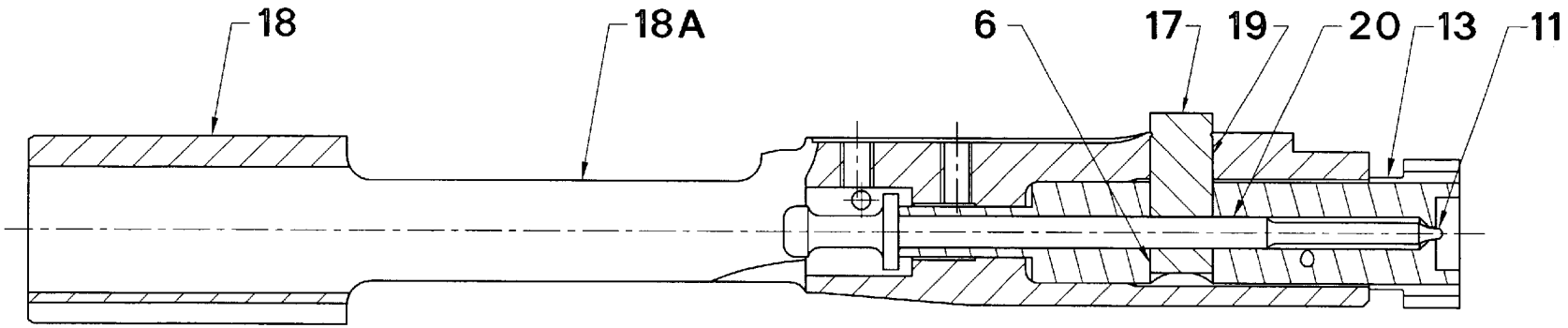
FIG. 6 is a side cross-section of a training bolt carrier assembly according to the invention.

In FIG. 1 the four major groups of a typical prior art rifle in the class of 5.56 mm M16A2 gas operated rifles and carbines are shown: upper receiver assembly 1, bolt carrier assembly 2, lower receiver buttstock assembly 3, and magazine 4. According to the invention, only bolt carrier assembly 2 will be altered to convert the prior art weapon to a training configuration that will fire a recoil-activating round, such as a reduced-energy training ammunition as represented by U.S. Pat. Nos. 5,359,937 or 5,492,063 in a 5.56 mm version (the former shown as training cartridge 21 in FIG. 8A).

FIGS. 2A and 2B show a prior art bolt 5, which is part of prior art bolt carrier assembly 2. Bolt 5 contains locking hole 6, gas seal 7, bolt locking lugs 8, front end recess 9, ejector 10, firing pin hole 11A and extractor 12. The diameter of front end recess 9 is denoted by the letter A.

Figure 8A:
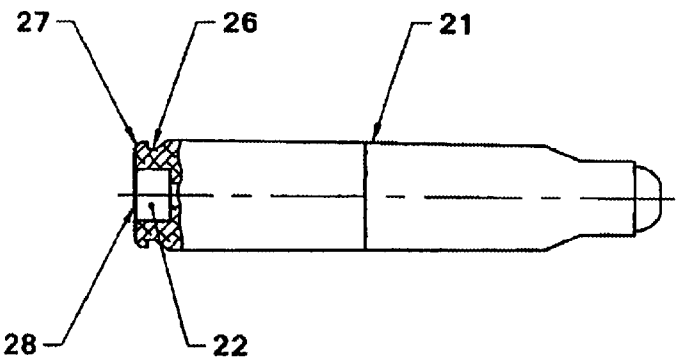
FIGS. 8A and 8B show side and end views of a 5.56 mm reduced-energy training cartridge as represented by U.S. Pat. No. 5,359,937.

FIGS. 3A and 3B depict training bolt 13 of the invention as modified with respect to prior art bolt 5. Since the training configuration is not gas operated, the gas seal 7 has been eliminated to reduce the cost of fabrication. Locking hole 6, bolt locking lugs 8, ejector 10, firing pin hole 11A and extractor 12 are all identical to the prior art. Training recess 14, however, differs from prior art recess 9 in that its diameter, denoted by the letter B, is smaller than prior art diameter A (i.e., B<A) by approximately 0.020 inch, although this may vary depending on the design of the training cartridge 21 (FIG. 8A).

FIG. 4A shows a prior art bolt carrier 15, which is another part of prior art bolt carrier assembly 2, containing cam groove 16 and gas port 16A. FIG. 4B shows prior art cam pin 17, which goes through both cam groove 16 of prior art bolt carrier 15 and locking hole 6 of prior art bolt 5 after bolt 5 is inserted into bolt carrier 15 during assembly of prior art bolt carrier assembly 2.

FIG. 5 depicts training bolt carrier 18 of the invention as modified from prior art bolt carrier 15. Since the training configuration is not gas operated, the gas port 16A has been eliminated to reduce the cost of fabrication. In addition, prior art cam groove 16 has been replaced by locking hole 19. After training bolt 13 is inserted into training bolt carrier 18 to form training bolt carrier assembly 18A, as illustrated in FIG. 6, locking hole 6 of training bolt 13 is aligned with locking hole 19 of training bolt carrier 18 so that cam pin 17 can be inserted through said locking holes 19 and 6 to rigidly attach said training bolt 13 to said training bolt carrier 18. Also depicted is firing pin 20 containing striker tip 11.

Figure 7A:
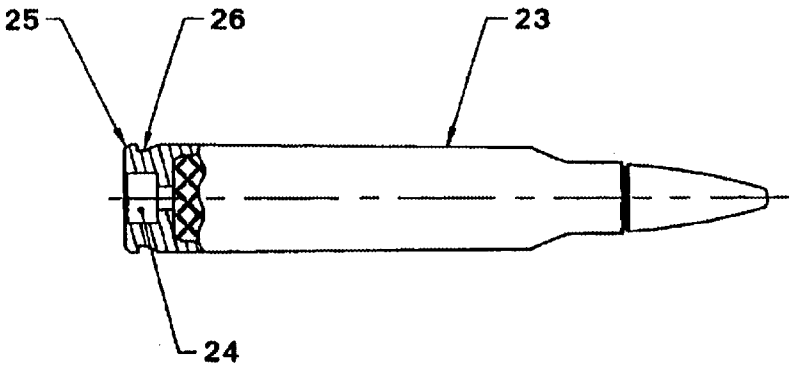
FIGURE 7A- PRIOR ART
FIGS. 7A and 7B show side and end views of a prior art standard 5.56 mm service cartridge.
Figure 7B:
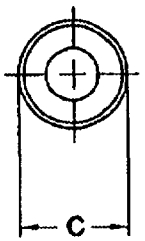
FIGURE 7B- PRIOR ART

FIGS. 7A and 7B depict a standard 5.56 mm service cartridge 23 containing standard primer 24, head end rim 25 and extraction groove 26. The diameter of rim 25 is denoted by the letter C.

Figure 8B:
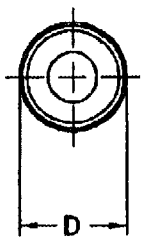
Figure 9:
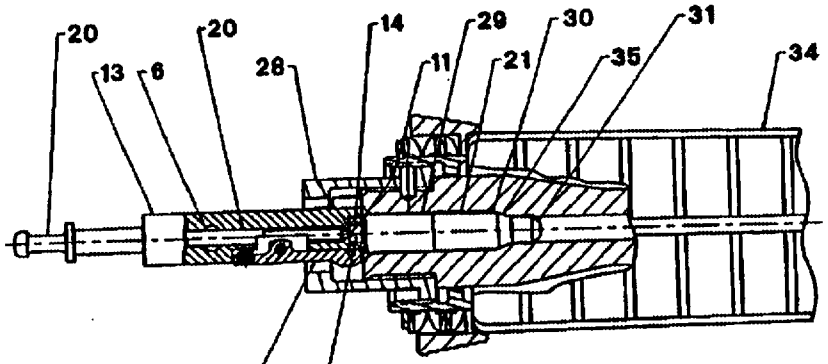
FIG. 9 depicts a side view of a reduced-energy training cartridge seated in a weapon chamber and fitted into the recessed end of a training bolt according to the invention at the moment that the firing pin has just been activated and struck the primer.

FIGS. 8A and 8B depict reduced-energy training cartridge 21, as represented by U.S. Pat. No. 5,359,937, in contrast to prior art cartridge 23. Prior art primer 24 may or may not differ from training primer 22, while extraction groove 26 is identical for both cartridges. Both rounds 21,23 have case dimensions that allow them to be chambered and fully seated in the chamber portion 35 of the barrel 34 of the firearm, as illustrated in FIG. 9. The diameter D of training rim 27, however, is slightly smaller than the diameter of prior art rim 25 (i.e., D<C), this difference being approximately 0.020 inch, depending on the diameter B of recess 14 of training bolt 13 (FIG. 3B). This difference in diameter is intended to ensure that the recess 14 of training bolt 13 will not receive a standard, prior art cartridge containing prior art rim 25.

Figure 10:
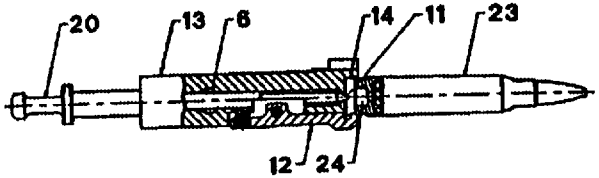
FIG. 10 depicts a live 5.56 mm standard service round unable to enter the front-end bolt recess of a training bolt according to the invention and, therefore, not coming into range for contact with the firing pin at the moment when said firing pin is activated.

Since only the training bolt carrier assembly 18A is different after a prior art M16A2-type weapon has been converted to fire said reduced-training ammunition 21, it is possible that a live round of 5.56 mm service ammunition 23 may be inadvertently chambered in the training weapon during a training session. An object of the invention is to ensure that a standard round will not be fired by a weapon modified for training purposes. The manner in which the possible firing of such a live round of service ammunition is excluded by the invention is illustrated in FIGS. 9 and 10.

Figure 9A:
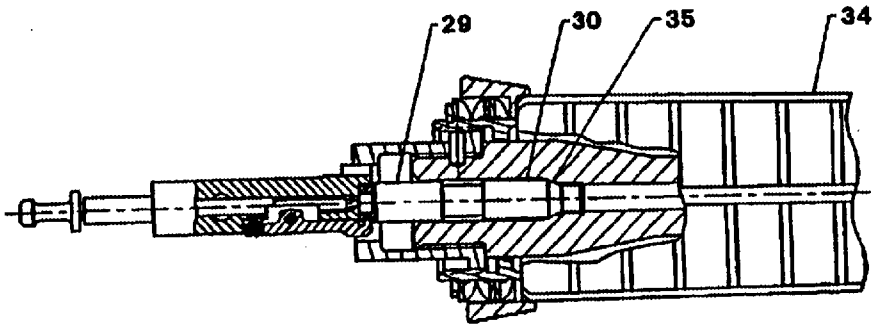
FIG. 9A shows a cross-sectional view of a reduced-energy training cartridge, as represented by U.S. Pat. No. 5,359,937, seated in a weapon chamber after firing.

As already described, the diameter of recess 14 of training bolt 13 (diameter B in FIG. 3B) and the rim diameter 27 of training round 21 (diameter D in FIG. 8B) are both slightly smaller than the corresponding dimensions for prior art bolt 5 (diameter A in FIG. 2B) and a standard service round of 5.56 service ammunition 23 (diameter C in FIG. 7B). Further, diameter D of rim 27 of reduced-energy training cartridge 21 is such that the head end 28 of said reduced-energy training cartridge 21 will fit snugly into diameter B of recess 14 of training bolt 13 and be gripped there by the extractor 12, which fits over said rim 27 and settles into extraction groove 26. In this position, head end face 28 of primer 22 is flush against both the flat bottom of said recess 14 and striker tip 11 of retracted firing pin 20 located therein. When the weapon is activated, firing pin 20 thrusts forward and its striker tip 11 strikes primer 22, as shown in FIG. 9, thereby igniting said primer 22 and firing reduced-energy training round 21. According to U.S. Pat. No. 5,359,937, the reduced-energy training round 21, which consists of training case 29, training sabot 30 and training projectile 31, will appear as shown in FIG. 9A after firing, with training sabot 30 fully extended from training case 29. In this manner, said training cartridge 21 has expanded longitudinally upon firing. Another configuration that provides the same result is described in U.S. Pat. No. 5,492,063.

Again as previously described, the diameter of rim 25 of a standard round of 5.56 mm service ammunition 23 (diameter C in FIG. 7B) is larger than the diameter of recess 14 of training bolt 13 (diameter B of FIG. 3B), having been designed to fit into diameter A of recess 9 of prior art bolt 5. Thus, should a round of live service ammunition 23 be chambered in the upper receiver assembly 1 of an M-16 A2 weapon converted to fire reduced-energy training ammunition 21, the diameter C of rim 25 of said standard cartridge 23 will not fit into diameter B of recess 14 of training bolt 13, as shown in FIG. 10. Since the depth of recess 14 is approximately 0.125 inch and the maximum stroke of firing pin 20 is only about 0.025 inch, striker tip 11 of firing pin 20 does not nearly reach primer 24, hence said training round is not fired and the weapon will jam to signal that there is a problem.

Figure 11A:
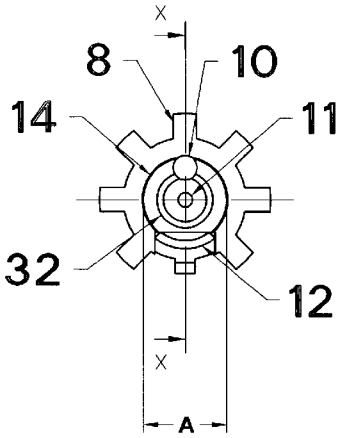
FIGS. 11A and 11B show end and cross sectional views of the front end recess of a training bolt containing a partial annular protuberance located in the bottom of the recess.
Figure 12B:
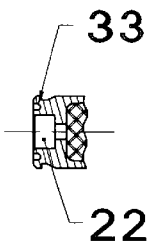
FIGS. 12A and 12B show end and cross sectional views of the head end of a reduced-energy cartridge containing a complementary annular groove located in the head end face of the training cartridge.
Figure 12A:
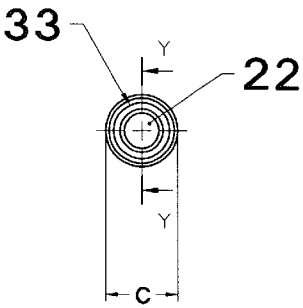
Figure 11B:
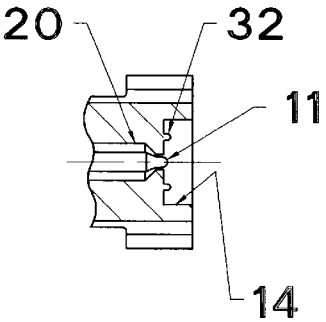

An alternate method for preventing primer 24 of a standard cartridge 23 from coming into contact with firing pin striker tip 11 is illustrated in FIGS. 11A, 11B, 12A and 12B. A partial protuberance 32, preferably annular (which may be interrupted by the ejector 10), is added to the bottom of the recess 14 of training bolt 13 to preclude the firing of a standard round. In this embodiment the diameter B of the training bolt reverts to standard diameter A, as shown in FIGS. 11A and 11B. A matching full annular groove 33 is added to head end 28 of the reduced-energy training cartridge 21, wherein diameter D of said training cartridge reverts to standard diameter C, as shown in FIGS. 12A and 12B.

Should a live service round be chambered accidentally, it would not fire because its head end would be obstructed by protuberance 32 such that striker tip 11 of firing pin 20 would not reach primer 24. On the other hand, when reduced-energy cartridge 21 is chambered, its groove 33, which is complimentary in form and matches in size and shape protuberance 32, will not be impeded from settling snugly into recess 14, thereby coming into position to be fired when hit by striker tip 11 of firing pin 20 upon activation of the weapon.

Other, methods can also be employed to prevent the firing of an inadvertently chamber round of live service ammunition. For example, the rim of the training cartridge could be dimensioned to be of some shape other than circular, such as hexagonal, with the front end recess of the training bolt being formed to match it. The circular shape of the standard ammunition would, therefore, not be able to penetrate into said recess with the result, once again, of the primer being well out of reach of the striker head of the firing pin. The invention, therefore, relies upon the selective dimensioning of the recess in the training bolt.

Many rounds of various types of standard 5.56 mm service ammunition have been tested in M16A2 rifles converted to fire reduced-energy training ammunition to demonstrate the live-fire exclusion feature of the invention with complete success. Similarly, large numbers of 5.56 mm reduced-energy training ammunition with reduced rim diameters, as represented by a 5.56 mm version of U.S. Pat. No. 5,359,937, have been fired from the same converted rifles to demonstrate conclusively that only the bolt carrier assembly need be changed to yield, in conjunction with the live-fire exclusion feature, a reliable and safe training weapon system.

The invention, while demonstrated by the M16A2 rifle, is applicable to all firearms wherein a conversion to fire low-energy ammunition is combined by the safety features of live-fire exclusion.

CONCLUSION

The foregoing constitutes a description of specific embodiments showing how the invention may be applied and put into use. These embodiments are only exemplary. The invention in its broadest and more specific aspects is further described and defined in the claims which follow. These claims, and the language used therein, are to be understood in terms of the variants of the invention which has been described. They are not to be restricted to such variants, but are to be read as covering the full scope of the invention as is implicit within the invention and the disclosure that has been provided herein.

The embodiments of the invention in which an exclusive property or privilege is claimed are defined as follows:

1. A firearm having:

a) a standard barrel and standard chamber of respective given diameter that are dimensioned to fire standard ammunition, the standard ammunition having a cartridge with a head end and a case that are of a diameter that is substantially equal to the diameter of said chamber;

b) a standard upper receiver assembly for connection to said standard barrel;

c) a standard lower receiver buttstock assembly;

d) a magazine; and e) a training bolt carrier assembly comprising a training bolt carrier and a training bolt with a firing pin and training bolt recess with a base through which the firing pin will operate by advancement into said recess upon firing, said training bolt recess being dimensioned or shaped to exclude the seating of the head end of said standard ammunition in said bolt recess whereby the firing of standard ammunition is precluded, said training bolt carrier assembly being dimensioned for mounting in the firearm with said training bolt and training bolt carrier being free to recoil upon firing so as to effect cycling of the firearm through a blow-back operation, said firearm being in combination with a reduced-energy cartridge having:

f) a case dimensioned to allow said reduced-energy cartridge to seat fully in the standard barrel chamber of said firearm, g) a head end which is dimensioned or shaped to seat fully in the training bolt recess, within reach of said firing pin upon firing, and h) a case that is divided into two portions that expand longitudinally upon firing to effect cycling of the weapon through blow-back operation.

2. A firearm as in claim 1 wherein the training bolt recess is circular and is of a reduced diameter that will exclude the reception and seating of the head end of a standard cartridge, and the head end of the reduced-energy cartridge is circular and of a diameter that will allow said reduced energy cartridge head end to seat in said training bolt recess.

3. A firearm as in claim 2 wherein the training bolt is fixed to the training bolt carrier for recoil of said training bolt and training bolt carrier as a unit upon firing as part of said blow-back operation.

4. A firearm as in claim 1 wherein the base of the training bolt recess comprises a protrusion which will preclude the seating of a standard cartridge the training bolt recess, and the reduced-energy cartridge is provided at its head end with a recess that is of complementary shape to said protrusion to permit the head end of the reduced-energy cartridge to seat in said training bolt recess.

5. A firearm as in claim 4 by wherein the training bolt is fixed to the training bolt carrier for recoil of said training bolt and training bolt carrier as a unit upon firing as part of said blow-back operation.

6. A firearm as in claim 1 wherein the training bolt is fixed to the training bolt carrier for recoil of said training bolt and training bolt carrier as a unit upon firing as part of said blow-back operation.

7. A standard firearm in combination with a training kit for use in converting the standard firearm into a training configuration for firing reduced energy ammunition, the standard firearm having:

a) a standard chamber of a given diameter fitted within a standard barrel and b) a standard bolt provided at its forward end with a standard bolt recess for receiving and embracing the head end of a standard cartridge having a casing and head end both of a diameter that is substantially the same as the chamber diameter, c) a standard receiver with a bolt carrier assembly that receives said standard bolt, and standard bolt carrier, wherein said training kit comprises:

d) a training bolt with a training bolt firing pin and a training bolt recess fitted within a training bolt carrier wherein the training bolt firing pin and training bolt recess are dimensioned or shared to exclude the reception and seating of the head end of said standard cartridge, whereby, with the standard cartridge loaded in said chamber and the training bolt installed in the firearm, the training bolt recess will not embrace the head end of the standard cartridge so that when said firing pin is released to advance into the training bolt recess, the head end of the standard cartridge is beyond the reach of the training bolt firing pin, said training bolt and training bolt carrier being dimensioned for mounting in the standard receiver of the firearm in a position to serve in place of the standard bolt and standard bolt carrier, but with said training bolt being free to recoil upon firing so as to effect cycling through a blow-back operation, and e) a reduced-energy cartridge having a casing that is dimensioned to be chambered in said standard chamber and having a head end that is dimensioned or shaped to be received and embraced by the training bolt recess to permit firing of said reduced-energy cartridge by said firing pin, said reduced-energy cartridge being provided with a case that is divided into two portions that expand longitudinally upon firing to effect cycling of the weapon through blow-back operation whereby the standard firearm is convertible to fire said reduced energy cartridge, excluding the chambering of a standard cartridge.

8. A standard firearm in combination with a training kit as in claim 7 wherein the training bolt recess is circular, having a reduced diameter that will exclude the reception and seating of the head end of a standard cartridge, and the head end of the reduced-energy cartridge is of a circular diameter that will allow said reduced-energy cartridge head end to seat in the training bolt recess.

9. A standard firearm in combination with a training kit as in claim 8 wherein the training bolt is fixed to the training bolt carrier for recoil of said training bolt and training bolt carrier as a unit upon firing as part of said blow-back operation.

10. A standard firearm in combination with a training kit as in claim 7 wherein a base of the training bolt recess comprises a protrusion which will preclude the seating of a standard cartridge in the training bolt recess, and the reduced-energy cartridge is provided at its head end with a recess that is of complementary shape to said protrusion to permit the head end of the reduced-energy cartridge to seat in the training bolt recess.

11. A standard firearm in combination with a training kit as in claim 10 wherein the training bolt is fixed to the training bolt carrier for recoil of said training bolt and training bolt carrier as a unit upon firing as part of said blow-back operation.

12. A standard firearm in combination with a training kit as in claim 7 wherein the training bolt is fixed to the training bolt carrier for recoil of said training bolt and training bolt carrier as a unit upon firing as part of said blow-back operation.

* * * * *